United States Patent [19]

Heikkila et al.

[11] Patent Number: 4,938,804

[45] Date of Patent: Jul. 3, 1990

[54] METHOD FOR THE CRYSTALLIZATION OF FRUCTOSE

[75] Inventors: Heikki Heikkila, Espoo, Finland; Vesa Kurula, Thomson, Ill.

[73] Assignee: Suomen Sokeri Oy, Helsinki, Finland

[21] Appl. No.: 199,487

[22] Filed: May 27, 1988

[30] Foreign Application Priority Data

Jun. 3, 1987 [FI] Finland ..... 872487

[51] Int. Cl.[5] ..... C13F 1/02; C13F 1/04

[52] U.S. Cl. ..... 127/60; 127/61; 127/62

[58] Field of Search ..... 127/58, 60, 61, 62

[56] References Cited

U.S. PATENT DOCUMENTS 3,928,062 12/1975 Yamauchi ..... 127/61

4,145,230 3/1979 Madsen et al. ..... 127/60

4,518,436 5/1985 Van der Poel ..... 127/60

4,666,527 5/1987 Ito et al. ..... 127/60

4,724,006 2/1988 Day ..... 127/60

*Primary Examiner*—Chung K. Pak

*Attorney, Agent, or Firm*—Baker & McKenzie

[57] ABSTRACT

The invention relates to a method for the production of crystalline fructose. The method comprises the steps of adding ethanol to a concentrated fructose solution; evaporating the mixture to a degree of supersaturation of at least 1.02; and adding anhydrous fructose seed crystals; removing ethanol-water azeotrope at a reduced pressure while maintaining the solution at a substantially constant temperature ranging from 50° C. to 75° C. so as to crystallize fructose; and recovering crystallized fructose, e.g. by centrifugation.

12 Claims, 1 Drawing Sheet

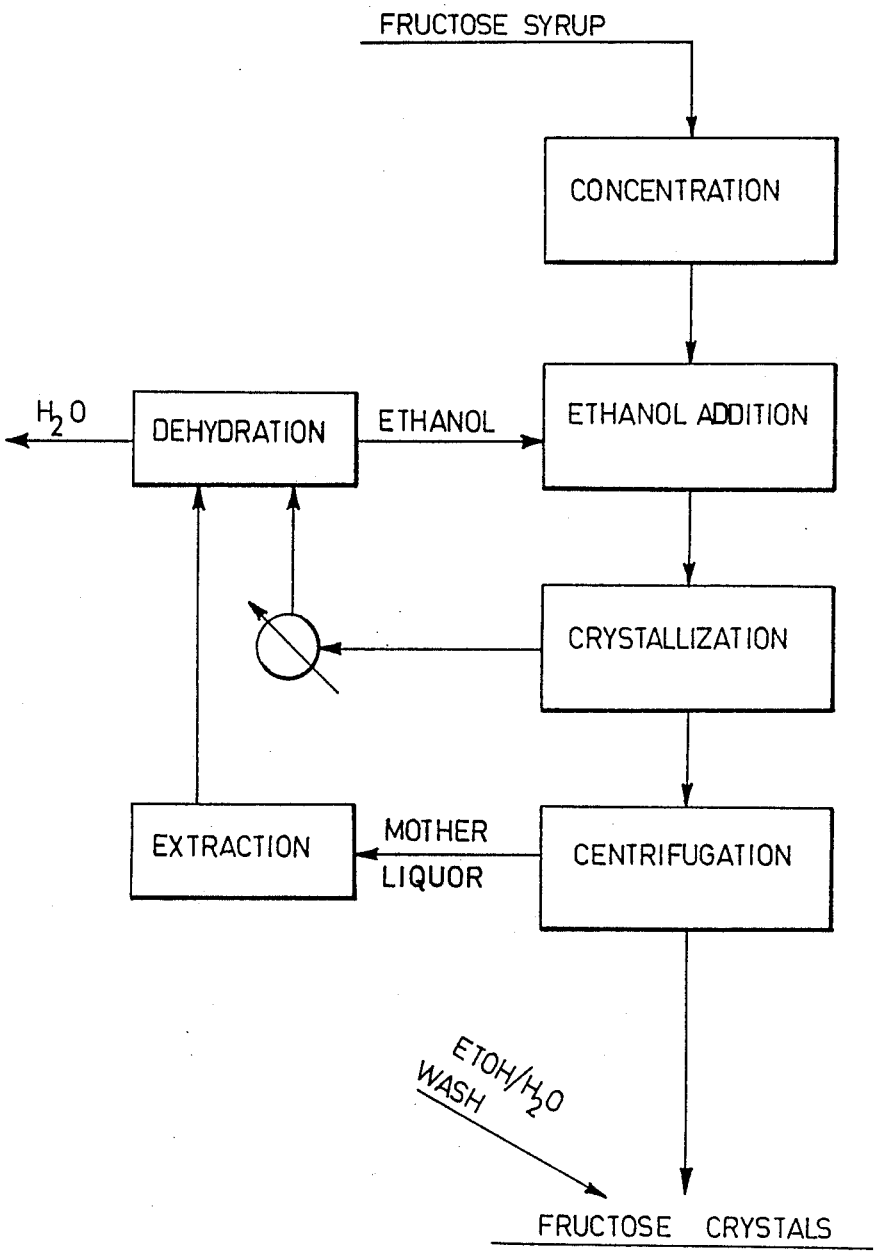
FRUCTOSE SYRUP
CONCENTRATION
ETHANOL ADDITION
ETHANOL
DEHYDRATION
$H_2O$
CRYSTALLIZATION
CENTRIFUGATION
MOTHER LIQUOR
EXTRACTION
ETOH/$H_2O$ WASH
FRUCTOSE CRYSTALS

METHOD FOR THE CRYSTALLIZATION OF FRUCTOSE

TECHNICAL FIELD

This invention relates to a method for the crystallization of fructose from an aqueous solution. More particularly, this invention relates to a method for the crystallization of fructose from a supersaturated ethanol-water solution.

BACKGROUND OF THE INVENTION

Fructose, also known as fruit sugar, is a mono-saccharide constituting one-half of the sucrose molecule. Inasmuch as the sweetness of fructose is about 1.3 to about 1.8 times that of crystalline sucrose, fructose is a commercially attractive sweetener as an alternative for sucrose and has been produced commercially for that purpose for a considerable time period. In food formulations, fructose is frequently used for special dietary purposes, e.g. to reduce the calorie content of desserts, jams and other industrially prepared products, to control blood sugar levels, and the like.

Methods for crystallization of fructose from aqueous or alcoholic solutions are known. Some such methods are described in Hara et al. U.S. Pat. No. 3,704,168 and in Forsberg et al. U.S. Pat. No. 3,883,365.

More specifically, Hara et al. U.S. Pat. No. 3,704,168 is directed to a crystallization process where fructose crystals are derived from a mixed liquid polyhydric and monohydric alcohol medium which is supersaturated with fructose at a temperature of −20° C. to 70° C. Forsberg et al. U.S. Pat. No. 3,883,365, on the other hand, describes a fructose crystallization method where a saturated aqueous fructose solution is adjusted to a pH value of 4.5 to 5.5 and cooled, optionally by a concurrent evaporation of the water present, to bring about crystallization of fructose.

It has now been discovered, however, that the crystallization of fructose can be expedited by crystallizing fructose from a solution at a substantially constant temperature while the solvent is removed from the solution by azeotropic evaporation.

SUMMARY OF THE INVENTION

The invention relates to a method for the crystallization of fructose from a fructose-containing ethanol-water solution. The process according to the invention is characterized by the steps of providing a supersaturated solution of fructose in an ethanol-water mixture, said solution having a degree of supersaturation with respect to fructose at crystallization temperature of at least about 1.02 and containing anhydrous fructose seed crystals; removing a minimum-boiling homogeneous ethanol-water azeotrope from said solution at a reduced pressure and while maintaining the solution at a substantially constant temperature in the range of about 50° C. to about 75° C. to crystalize dissolved fructose; and recovering the crystallized fructose.

The process according to the invention provides an efficient crystallization of fructose. Azeotropic removal of the solvent results in reduced crystal growth time. Crystal yield is increased as well.

In practicing the present invention, a supersaturated solution of fructose is prepared by using an ethanol-water mixture as the solvent. This solution has a degree of supersaturation with respect to fructose at crystallization temperature of at least about 1.02, preferably about 1.02 to about 1.1, and more preferably about 1.05. Crystallization is initiated by adding to the foregoing supersaturated solution anhydrous fructose seed crystals having a mean particle size of preferably about 40 to 50 micrometers.

Crystallization of dissolved fructose is carried out by removing from the supersaturated solution a minimum-boiling homogenous ethanol-water azeotrope at a reduced pressure and while maintaining the solution at a substantially constant temperature in the range of about 50° C. to about 75° C., preferably at about 65° C.

The produced crystals are recovered by centrifugation, filtration, or any other convenient solids-liquid separation expedient.

The removed azeotrope can be condensed. The produced condensate can be used to wash recovered fructose crystals. In addition, the condensate can be dehydrated to obtain substantially anhydrous ethanol which, in turn, can be recycled to the production stage of the supersaturated fructose solution.

The crystallization of fructose according to the present invention can be carried out as a batch or a continuous process with periodic or continuous removal of crystallized fructose, as desired.

BRIEF DESCRIPTION OF THE DRAWINGS

In the drawings, the sole FIGURE is a block flow diagram of an overall fructose crystallization process embodying the present invention.

DETAILED DESCRIPTION OF PREFERRED EMBODIMENTS

While crystallization commonly refers to the separation of a solid, crystalline phase from a liquid phase by cooling, evaporation, or both, the ensuing discussion primarily pertains to crystallization by evaporation at a substantially constant temperature. Also, the rate of crystallization usually involves two actions: (a) the rate of formation of new crystals, or nucleation, either in a clear solution or one containing solids, and (b) the rate of precipitation of solute on crystals already present, usually called crystal growth. The present invention relates to a method for enhancing the latter.

The deposition of a solid from a solution onto a crystal can take place only if there is a state of imbalance with a driving force, e.g., decrease in chemical concentration, between the solution and the crystal interface. This means that the solution must be supersaturated with respect to crystals of the size on which deposition is to occur before the crystals can grow by deposition from the solution.

The degree of supersaturation at a given temperature is defined by the following equation:

$$S = \frac{C_{ml}\,(100 - C_s)}{C_s\,(100 - C_{ml})}$$

where

S—degree of supersaturation $C_{ml}$—amount of substance in the mother liquor (weight %)

$C_s$—amount of substance in saturated solution (weight %)

The crystal yield is defined by the following equation:

$$Y = \frac{100\,(C_m - C_{ml})}{C_m\,(100 - C_{ml})}$$

where

Y—yield expressed as percentage $C_m$—amount of crystalline substance recovered (weight %)

$C_{ml}$—amount of substance in the mother liquid (weight %)

The starting material in the present method is a water solution of fructose, or fructose syrup, such as that obtainable by separation of fructose from isomerized glucose syrup as described in Melaja U.S. Pat. No. 3,692,582. The attached FIG. 1 shows a process sequence illustrating one suitable overall process. The process will be described more closely in the following.

In particular, fructose syrup is concentrated by evaporation of excess water to a dry solids content of at least about 90% by weight with a dry solids content of about 95% by weight being preferred. Next, ethanol is added to the fructose syrup to form a feed solution of fructose in the produced ethanol-water mixture. Upon further concentration, this feed solution serves as the mother liquor for the crystallization as will be described in greater detail hereinbelow.

The amount of ethanol to be added can vary, depending upon the amount of water present in the concentrated fructose syrup. The objective is, however, a minimum-boiling homogeneous ethanol-water azeotrope pressure. To that end, the ethanol-water mixture in the feed solution contains about 94 to about 98 percent by weight, preferably about 96 percent by weight of ethanol. Also, prior to introduction into a crystallizer, the feed solution is less than saturated with respect to fructose at the contemplated crystallization temperature. That is, the feed solution has a degree of supersaturation of less than 1. Preferably, the feed solution has a degree of supersaturation of about 0.9 to about 0.95 with respect to fructose at crystallization temperature.

Next, the feed solution is supersaturated to a desired degree of azeotropic evaporation, either upon introduction into the crystallizer, or by means of a pre-boiler. The desired degree of supersaturation is in the range of about 1.02 to about 1.1. The preferred degree of supersaturation is about 1.05.

The supersaturated feed solution serves as the mother liquor when combined with anhydrous fructose crystals which are dispersed within the mother liquor to provide original crystal surfaces on which additional crystal lattice units can form.

The anhydrous fructose seed crystals have a mean particle size of preferably about 40 to 50 micrometers. Preferably, full seeding of the mother liquor is effected for crystallization.

In any given instance the seed crystal quantity will depend on the particular size of the seed crystals, on the desired quantity of the finished crystals, and on the desired crystal size in accordance with the following equation:

$$M_s = (d_s/D)^3 M$$

where $M_s$—amount of seed crystals (kg)

$d_s$—effective diameter of seed crystals

M—amount of finished crystals (kg)

D—desired effective diameter of finished crystals.

The mother liquor containing the dispersed seed crystals is next subjected to a reduced pressure to effect azeotropic evaporation of the solvent while the mother liquor is maintained at a substantially constant temperature within the range of about 50° C. to about 75° C., preferably at about 65° C.

Inasmuch as a particular ethanol-water azeotrope is temperature-dependent as well as pressure-dependent, both the temperature of the mother liquor and the crystallizer pressure are monitored. In the method according to the invention, a reduced or subatmospheric pressure in the range of about 100 millibars to about 700 millibars is used.

Particularly preferred as process conditions for a mother liquid having a degree of supersaturation of about 1.05 are a temperature of about 65° C. and a pressure of about 480 millibars.

Crystal growth takes place in the crystallizer as the ethanol-water azeotrope is removed by evaporation and subsequently condensed. The degree of supersaturation of the mother liquor is kept substantially constant by continuous, or continual, addition of fresh feed solution. The rate of addition for the feed solution is determined by the rate of crystal formation which can be monitored by rate of change in the refractive index of the mother liquor.

In a batch process operation, the fructose crystals usually are separated from the mother liquor when a crystal yield of about 60 to 70 percent has been achieved. The separation can be effected by centrifugation, filtering, and like expedients.

Recovered fructose crystals usually have a size in the range of about 200 to about 500 micrometers. After recovery, the crystals can be washed, if desired, to further enhance purity. It is convenient to do so utilizing an ethanol-water mixture that has about the same ethanol/water mol ratio as the azeotrope removed from the crystallizer. An aliquot of the condensate from the crystallizer can be used for this purpose.

The condensed azeotrope contains a substantial amount of ethanol which can be recycled in the fructose crystallization process upon dehydration. Ethanol dehydration can be achieved by several means. For example, the desired separation of water from ethanol can be effected by reduced pressure distillation at about 85–90 millibars or by the use of an entrainer such as n-pentane, benzene, or cyclo-hexane as described by Black, Chem. Eng. Prog. 76(9):78 (1980).

After crystallization, the spent mother liquor is recovered concurrently with fructose crystal recovery by centrifugation, filtration, or otherwise. Thereafter the recovered mother liquor is distilled.

This invention is illustrated further by the following examples.

EXAMPLE 1:

Azeotropic Crystallization of Fructose

A solution of fructose in water, separated from isomerized glucose syrup was concentrated by evaporation to a dry solids content of about 95 percent by weight to produce a fructose syrup. About 4.6 kilograms of fructose syrup were produced containing about 0.2 kilograms of water.

The produced fructose syrup (about 4.6 kg) was then combined with anhydrous ethanol (about 7.5 kg) at a temperature of about 67° C. to form a solution of fructose in an ethanol-water mixture to be used as a feed solution. The degree of supersaturation of the feed solution was observed to be about 0.95.

About one-third of this feed solution was introduced via a feed line into a vertical evaporation crystallizer equipped with a stirrer, heat exchanger, vacuum line, vapor condenser, and steam line. Crystallizer instrumentation included a refractometer, vacuum gauge, and a thermometer. The crystallizer charge was then evaporated to elevate the degree of supersaturation to a value of about 1.05 and then seeded with anhydrous fructose seed crystals (about 3.8 g; mean particle size about 40 micrometers). At seeding, the crystallizer charge contained about 1.45 kg of fructose plus incidental impurities, about 2.25 kg of ethanol, and about 0.7 kg of water. The pH value of the crystallizer charge was observed to be about 5.0 (4.0–6.0).

Growth of crystals in the crystallizer was maintained by evaporating therefrom an ethanol-water azeotrope containing about 97 percent by weight ethanol. Solution temperature in the crystallizer was about 65° C. and a reduced pressure of about 480 millibars was maintained. Crystallization was continued for a time period of about 5 hours during which time period the remainder of the feed solution was gradually fed to the crystallizer so as to maintain a substantially constant dry solids content of about 34 percent by weight in the mother liquor as indicated by the refractive index of the mother liquor converted to dry solids content.

Crystallization was terminated after the foregoing five-hour crystallization period, and the produced fructose crystals were recovered by centrifugation. Upon termination of crystallization, the crystallizer contained about 1.1 kg of ethanol, about 0.33 kg of water, about 4.1 kg of fructose and about 0.22 kg of impurities. Of the fructose present, about 3.3 kg was in crystalline form and about 0.8 was dissolved in the liquid phase present in the crystallizer. The liquid phase also was observed to contain about 0.20 kg of the aforementioned impurities.

After centrifugation, the recovered crystals were washed with ethanol-water mixture obtained by condensing the azeotrope evaporated from the crystallizer. The ultimate crystalline product was crystalline fructose having a mean particle size of about 400 micrometers, high purity, and low hygroscopicity.

Ethanol in the condensate obtained by condensing the evaporated azeotrope was enriched to an ethanol content of about 99.5 percent by weight by distillation.

EXAMPLE 2:

Fructose Crystallization

An aliquot of a fructose solution in water, separated from isomerized glucose syrup and containing relatively small amounts of other sugars, was concentrated to a dry solids content of about 95 percent by weight and was combined with anhydrous ethanol to form the following fee solution:

| | |
|---|---|
| ethanol | 1259.9 grams |
| fructose | 579.1 grams |
| water | 45.3 grams |
| others | 43.5 grams |
| Total | 1927.8 grams |

The foregoing feed solution was subjected to evaporation crystallization in a batch crystallizer under the following conditions:

| | |
|---|---|
| temperature | 65° C. |
| pressure | 480 millibars |
| time period | 5 hours |
| seed crystal amount | 0.3 grams |
| mean seed crystal size | 0.05 millimeter |

During crystallization, an ethanol-water mixture was evaporated and then condensed. About 1077 grams of condensate was obtained. The condensate contained about 1052.1 grams of ethanol and about 24.9 grams of water.

The crystals were recovered by centrifugation. Fructose crystals having a mean size of about 400 micrometers were obtained in about 67 percent yield. The purity of the product was substantially 100 percent.

The foregoing description of the preferred embodiments and the accompanying examples are not to be taken a limiting. Still other variations in process parameters without departing from the spirit and scope of this invention are possible and will readily present themselves to those skilled in the art.

We claim:

1. A crystallized fructose recovery process which comprises the steps of:

concentrating fructose syrup to a dry solids content of at least about 90% by weight;

adding ethanol to the concentrated syrup to form a solution of fructose in an ethanol-water mixture having an ethanol-water weight ratio sufficient to from an ethanol-water azeotrope;

supersaturating the resulting solution by azeotropic evaporation to a degree of supersaturation with respect to fructose at crystallization temperature of at least about 1.02;

combining the supersaturated solution with anhydrous fructose seed crystals to provide a mother liquor with fructose seed crystals dispersed therein;

subjecting the mother liquor to a reduced pressure while at a substantially constant temperature in the range of about 50° C. to about 75° C. and removing a minimum-boiling homogeneous ethanol-water azeotrope therefrom in an amount sufficient to crystallize fructose dissolved in the mother liquor; and recovering the crystallized fructose from the mother liquor.

2. The process in accordance with claim 1 wherein said fructose seed crystals have a mean particle size of at least about 40 micrometers.

3. The process in accordance with claim 1 wherein said fructose seed crystals have a mean particle size of about 50 micrometers.

4. The process in accordance with claim 1 wherein said solution is supersaturated to a degree of supersaturation in the range of about 1.02 to about 1.1.

5. The process in accordance with claim 1 wherein said solution is supersaturated to a degree of supersaturation of about 1.05.

6. The process in accordance with claim 1 wherein the mother liquor is subjected to a reduced pressure in the range of about 100 millibars to about 700 millibars.

7. The process in accordance with claim 1 wherein the mother liquor is maintained at a degree of supersaturation of about 1.05, a reduced pressure of about 480 millibars, and a temperature of about 65° C. during crystallization.

8. The process in accordance with claim 1 wherein the removed ethanol-water azeotrope is condensed, the resulting condensate is dehydrated to produce substantially pure ethanol, and at least a portion of the produced ethanol is recycled for addition to the concentrated syrup.

9. The process in accordance with claim 8 wherein an aliquot of the condensate is used to wash the recovered crystallized fructose.

10. The process in accordance with claim 1 wherein the dry solid content of said fructose syrup is about 95% by weight.

11. The process in accordance with claim 1 wherein said crystallized fructose is recovered periodically.

12. The process in accordance with claim 11 wherein said crystallized fructose is recovered continuously.

* * * * *